US010487507B2

(12) United States Patent
Kasprzak et al.

(10) Patent No.: US 10,487,507 B2
(45) Date of Patent: Nov. 26, 2019

(54) REROOFING SHINGLE

(71) Applicant: Owens Corning Intellectual Capital, LLC, Toledo, OH (US)

(72) Inventors: Christopher P. Kasprzak, Holland, OH (US); Andrew Panelli, Homer Glen, IL (US); Bert W. Elliott, Toledo, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 15/792,900

(22) Filed: Oct. 25, 2017

(65) Prior Publication Data

US 2018/0112405 A1 Apr. 26, 2018

Related U.S. Application Data

(60) Provisional application No. 62/412,321, filed on Oct. 25, 2016.

(51) Int. Cl.

| | |
|---|---|
| ***E04D 1/12*** | (2006.01) |
| ***E04D 1/20*** | (2006.01) |
| ***E04D 1/34*** | (2006.01) |

(52) U.S. Cl.

CPC ..... *E04D 1/12* (2013.01); *E04D 1/20* (2013.01); *E04D 1/34* (2013.01); *E04D 2001/3435* (2013.01)

(58) Field of Classification Search

CPC .... E04D 1/12; E04D 1/20; E04D 1/34; E04D 2001/3435; E04D 1/28

See application file for complete search history.

(56) References Cited

U.S. PATENT DOCUMENTS

| | | | | |
|---|---|---|---|---|
| 1,810,674 | A * | 6/1931 | Muhr | E04D 1/265 52/96 |
| 2,044,782 | A * | 6/1936 | Harshberger | E04D 1/28 52/232 |
| 4,322,928 | A * | 4/1982 | Freiborg | E04D 1/26 52/521 |
| 4,672,790 | A * | 6/1987 | Freiborg | E04D 1/26 52/521 |
| 4,825,616 | A * | 5/1989 | Bondoc | E04D 1/20 52/518 |
| 6,936,329 | B2 * | 8/2005 | Kiik | A47G 27/0468 428/141 |
| 8,430,983 | B2 | 4/2013 | Vermilion et al. | |
| 8,898,987 | B1 * | 12/2014 | Amatruda | E04D 1/28 52/557 |

(Continued)

*Primary Examiner* — Brian D Mattei

(74) *Attorney, Agent, or Firm* — Calfee, Halter & Griswold LLP

(57) ABSTRACT

An exemplary roofing system for covering an existing shingle roof with an exposure height measured between bottom edges of adjacent courses is disclosed. The roofing shingle system comprising includes a plurality of reroofing shingles. The reroofing shingles have an exposure portion extending from a top edge to a bottom edge for a height that is at least the exposure height of the existing shingle roof. At least one course of reroofing shingles is installed on at least one course of the existing shingle roof, wherein the course of the existing roof is covered by the at least one course of reroofing shingles. The top edge of the reroofing shingles abuts the bottom edge of the adjacent course of existing shingles.

9 Claims, 8 Drawing Sheets

(56) References Cited

U.S. PATENT DOCUMENTS

| | | | | |
|---|---|---|---|---|
| 9,631,383 | B1 * | 4/2017 | Mathieson | E04G 23/0281 |
| 2005/0284068 | A1 * | 12/2005 | Smith | E04D 3/30<br>52/506.01 |
| 2017/0089083 | A1 * | 3/2017 | Guerra | E04D 1/18 |

* cited by examiner

REROOFING SHINGLE

CROSS-REFERENCE TO RELATED APPLICATIONS

The present application claims the benefit of U.S. Provisional Application Ser. No. 62/412,321, filed on Oct. 25, 2016, titled REROOFING SHINGLE, the disclosure of which is incorporated herein by reference in its entirety.

TECHNICAL FIELD

The present invention relates generally to roof shingles for protecting a roof of a structure, and more particularly, reroofing shingles for application on top of an existing shingled roof.

BACKGROUND OF THE INVENTION

Many structures have pitched, shingled roofs, which prevent water, e.g., rain water, from entering the structures by causing water to pass over the shingles and off the roofs. A pitched, shingled roof has a pitched substrate, such as a plurality of plywood sheets, with a plurality of shingles attached thereto.

Each shingle has an upper portion (i.e., a headlap portion) and a lower portion (i.e., an exposure portion) wherein the exposure portion is exposed to the environment. The shingles are typically attached to the substrate in rows known as courses wherein the exposure portion of an upper course of shingles overlaps the headlap portion of an adjacent lower course of shingles. For example, a first course of shingles may be attached to the substrate nearest the lowest point of the roof, i.e., the eave portion of the roof. A second course of shingles may then be attached to the substrate slightly higher on the roof than the first course. The shingles are placed so that the exposure portion of the second course of shingles overlaps the headlap portion of the first course of shingles. This overlapping continues with successive rows of shingles to the highest point on the roof, i.e., the hip or the ridge. Thus, only the exposure portion of the shingles are exposed to the environment. This overlapping of the shingles causes water to pass from shingles on a high course to shingles on the next lowest course of shingles without contacting the substrate. Accordingly, water passes from shingle to shingle and off the roof without contacting the substrate or entering the structure.

Attaching the shingles to the roof is typically achieved by the use of nails or other fastening devices that pass through the shingles and into or through the substrate. The fastening devices are typically placed through the headlap portion of the shingles so that they are overlapped by shingles in an adjacent higher course as described above. This placement of the fasteners prevents water from entering the structure through holes caused by the fasteners.

Some roofs have a membrane (i.e., an underlayment) located between the substrate and the shingles. The membrane may, as an example, be conventional tar paper that is nailed to the substrate. Strips of the membrane are typically attached to the roof in an overlapping fashion wherein an upper strip overlaps its adjacent lower strip. Accordingly, the membrane serves to shield the substrate from water should a shingle become damaged. For example, if a shingle becomes cracked or otherwise leaks, water will contact the membrane rather than the substrate. Water will then pass along the membrane to the next lowest shingle without contacting the substrate or entering the structure. Alternatively, water will pass along the membrane, under the shingles and off the roof.

Shingles may be damaged by impacts from hail or debris in a storm, or by prolonged exposure to the elements and temperature cycles. Existing methods of reroofing a shingled roof involve removing the shingles, fasteners, and membrane before applying new membrane and shingles.

SUMMARY

Exemplary embodiments of shingles are disclosed herein.

An exemplary roofing system for covering an existing shingle roof with an exposure height measured between bottom edges of adjacent courses is disclosed. The roofing shingle system comprising includes a plurality of reroofing shingles. The reroofing shingles have an exposure portion extending from a top edge to a bottom edge for a height that is at least the exposure height of the existing shingle roof. At least one course of reroofing shingles is installed on at least one course of the existing shingle roof, wherein the course of the existing roof is covered by the at least one course of reroofing shingles. The top edge of the reroofing shingles abuts the bottom edge of the adjacent course of existing shingles.

An exemplary method for installing a plurality of reroofing shingles on an existing roof with an exposure height measured between bottom edges of adjacent courses includes steps of: providing a plurality of reroofing shingles; installing a starter course; and installing at least one additional course. The reroofing shingles have an exposure portion extending from a top edge to a bottom edge for a height that is at least the exposure height of the existing shingle roof. The top edge of the reroofing shingles abuts the bottom edge of the adjacent course of existing shingles. The starter course is installed adjacent to a ridge course of shingles on the existing roof. The additional course of reroofing shingles is installed on at least one additional course of shingles on the existing roof.

BRIEF DESCRIPTION OF THE DRAWINGS

These and other features and advantages of the present invention will become better understood with regard to the following description and accompanying drawings in which.

DETAILED DESCRIPTION

Prior to discussing the various embodiments, a review of the definitions of some exemplary terms used throughout the disclosure is appropriate. Both singular and plural forms of all terms fall within each meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements. Also as described herein, the terms "substantially" and "about" are defined as at least close to (and includes) a given value or state (preferably within 10% of, more preferably within 1% of, and most preferably within 0.1% of).

Figure 1:
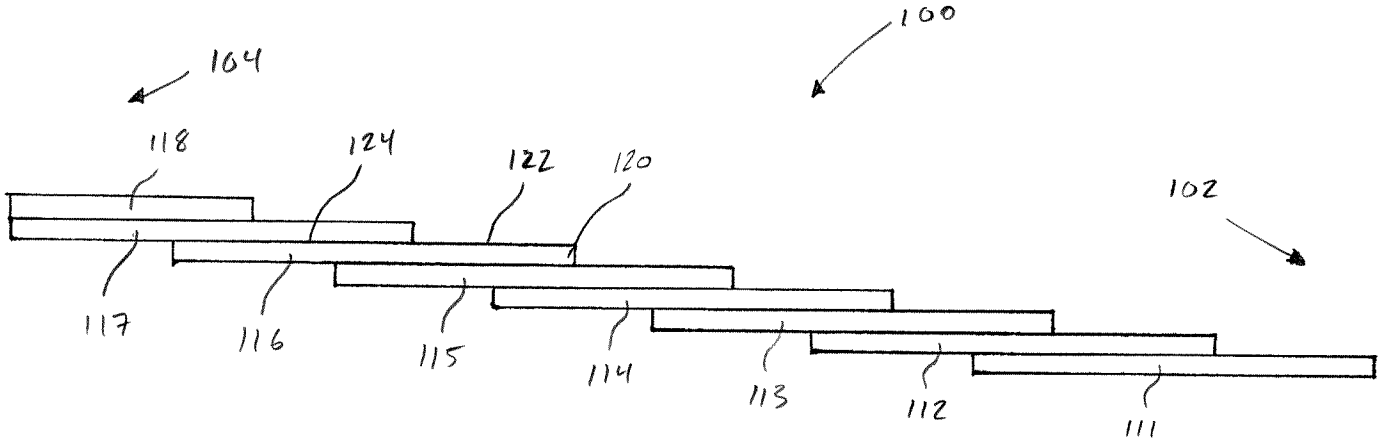
FIG. 1 is a cross-sectional view of shingles of an existing shingled roof.

Referring now to FIG. 1, shingles of an existing shingled roof 100 are shown. The roof 100 is a pitched roof extending from an eave 102 to a ridge 104. Shingles 120 of the existing roof 100 are applied in courses on top of an optional underlayment (not shown) and sheeting and/or decking (not shown). The shingles 120 may be single-layer three-tab shingles, or may be laminate shingles, such as the laminate shingles described in U.S. Pat. No. 8,430,983, which is incorporated herein by reference in its entirety.

The courses of shingles 120 include a first course 111, a second course 112, a third course 113, a fourth course 114, a fifth course 115, a sixth course 116, a seventh course 117, and a ridge course 118. The numbering of the courses corresponds to the order in which they are installed, with the first course 111 starting at the eave 102 of the roof 100 and the seventh course 117 reaching the ridge 104. Each shingle 120 includes an exposure portion 122 and a headlap portion 124. The exposure portion 122 of the shingle 120 is the portion of the shingle 120 that is not covered by shingles in the next course, and is therefore exposed to the environment. The exposure portion 122 of the shingle 120 may include slits that divide the exposure portion 122 into multiple tabs (not shown). As the courses of shingles 120 are installed, the exposure portion 122 of one course overlaps the headlap portion 124 of the previous course. While seven courses 111, 112, 113, 114, 115, 116, 117 and a ridge course 118 are shown in FIG. 1, the existing shingled roof 100 may have any number of courses necessary to cover the roof 100 from eave 102 to ridge 104.

Referring now to FIGS. 2-8, the existing shingled roof 100 is shown with various reroofing shingles installed forming new roofs 200, 300, 400, 500, 600, 700, 800 on top of the existing shingled roof 100. The new roofs 200, 300, 400, 500, 600, 700, 800 cover the exposure portions 122 of the shingles 120 of the existing shingled roof 100, providing the existing roof 100 with a new exposed surface. The new surface provided by the reroof shingles protects and covers any damaged portions of the existing roof 100. The new roof may also provide a new cosmetic appearance, for example, if different color shingles are used. The shingles of the existing and new roofs shown in FIGS. 2-8 can be discrete width shingles, such as, for example, a three-tab shingle, or can be a rolled product that can be unrolled to form a course of shingles across a roof surface.

Figure 2:
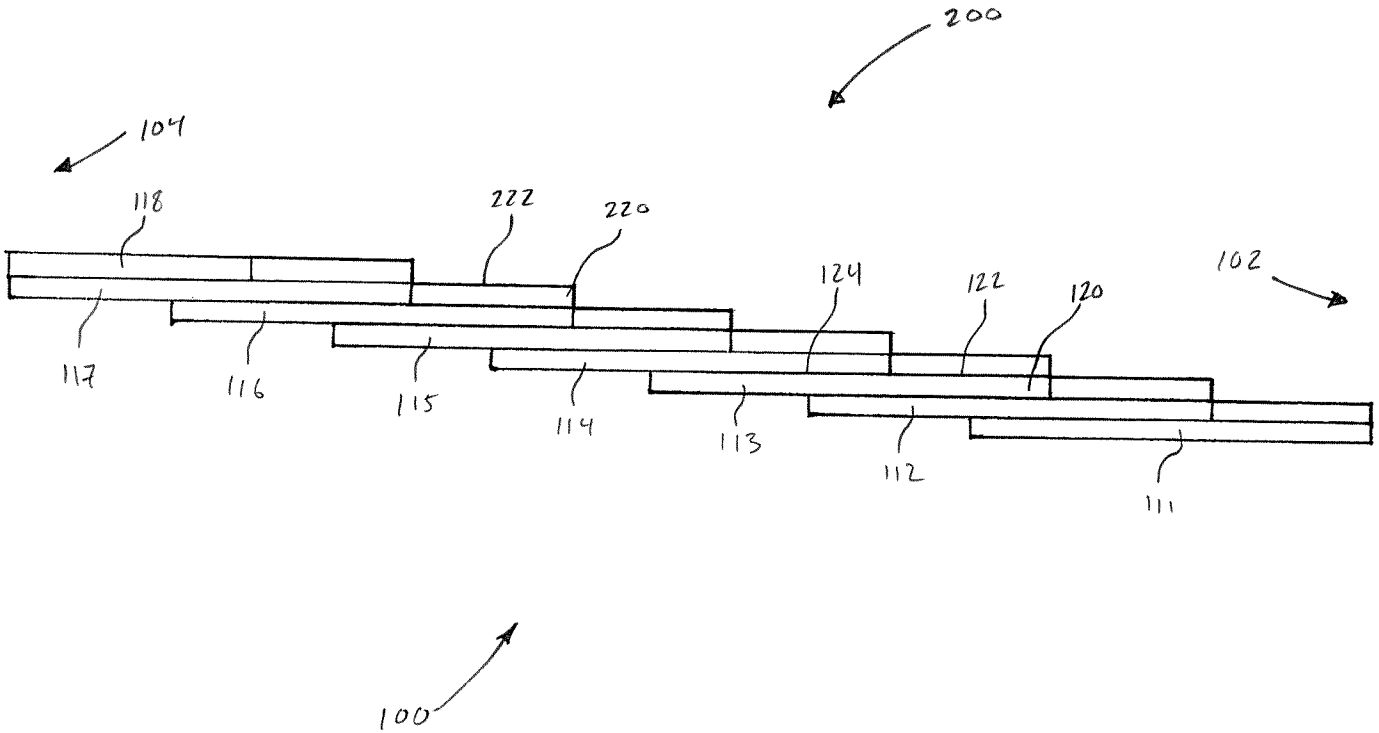
FIG. 2 is a cross-sectional view of exemplary reroofing shingles applied to shingles of the existing shingled roof.

Referring now to FIG. 2, an exemplary new roof 200 is shown installed on top of the existing roof 100. The new roof 200 is formed of reroof shingles 220 that are installed on top of the exposure portion 122 of the shingles 120 of the existing roof 100. The reroof shingles 220 include an exposure portion 222 that is the same width as the exposure portion 122 of the shingles 120 of the existing roof 120. The reroof shingles extend from a top edge to a bottom edge. The top edge of the reroof shingles abuts the bottom edge of the adjacent course of existing shingles. The reroof shingles 220 can be installed starting at either the eave 102 or the ridge 104 of the roof 100. For example, a first course of reroof shingles 220 can be installed on top of the exposure portion 122 of the seventh course 117 of the existing roof 100. Alternatively, a first course of reroof shingles 220 can be installed on top of the exposure portion 122 of the first course 111 of the existing roof 100. Installing the new roof 200 from ridge 104 to eave 102 allows an installer to install the new roof 200 without stepping on the newly installed reroof shingles 220. The reroof shingles 220 may be attached to the existing roof 100 by any suitable means, such as, for example, adhesive, nails, sealant, or other fastening devices. In one exemplary embodiment, the re-roof shingles are installed with adhesives and fasteners do not extend through the re-roof shingles 220. In some embodiments, a single layer of reroof shingles 220 is applied. In some embodiments, multiple layers of reroof shingles 220 are applied. In some embodiments, additional components, such as, for example, a rolled adhesive and a top sheet, may be installed between the existing roof 100 and the reroof shingles 220.

Figure 3:
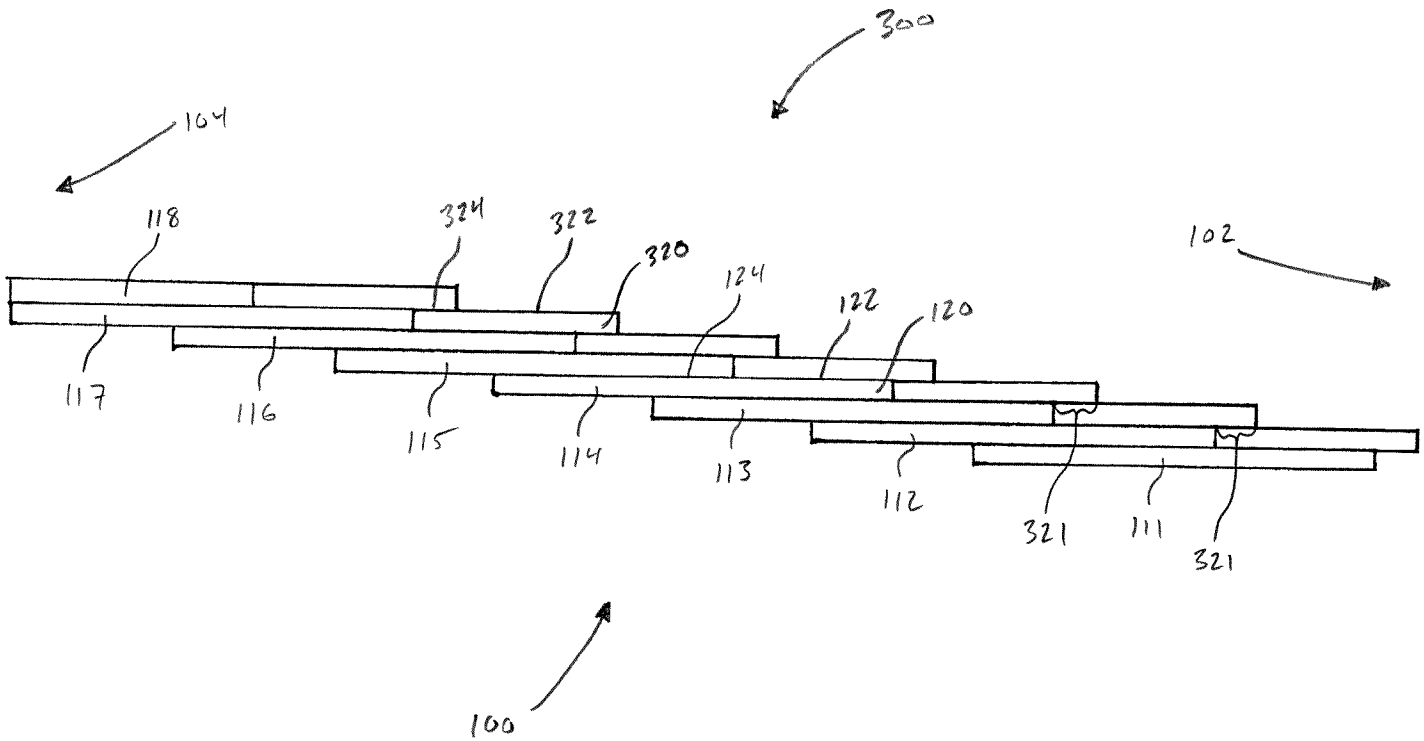
FIG. 3 is a cross-sectional view of exemplary reroofing shingles applied to shingles of the existing shingled roof.

Referring now to FIG. 3, an exemplary new roof 300 is shown installed on top of the existing roof 100. The new roof 300 is formed of reroof shingles 320 that are installed on top of the exposure portion 122 of the shingles 120 of the existing roof 100. The reroof shingles 320 include an exposure portion 322 and a headlap portion 324. The reroof shingles extend from a top edge to a bottom edge. The top edge of the reroof shingles abuts the bottom edge of the adjacent course of existing shingles. The reroof shingle 320 is slightly wider than the exposure portion 122 of the shingle 120 of the existing roof 100 such that the reroof shingle 320 extends beyond the exposure portion 122 of the shingle 120. Extending the reroof shingle 320 beyond the exposure portion 122 of the shingle 120 provides additional protection by covering the seam between existing shingles 120 and reroof shingles 320. The reroof shingles 320 can be installed starting at either the eave 102 or the ridge 104 of the roof 100. For example, a first course of shingles 320 can be installed on top of the exposure portion 122 of the seventh course 117 of the existing roof 100. When starting at the ridge 104 of the roof 100, the headlap portion 324 of successive courses of reroof shingles 320 is inserted into the groove formed between the previous reroof shingle 320 and the exposure portion 122 of the course below until the reroof shingle 320 butts against the shingles 120 of the existing roof 100. Alternatively, a first course of shingles 320 can be installed on top of the exposure portion 122 of the first course 111 of the existing roof 100. Installing the new roof 300 from ridge 104 to eave 102 allows an installer to install the new roof 300 without stepping on the newly installed reroof shingles 320. The reroof shingles 320 may be attached to the existing roof 100 by any suitable means, such as, for example, adhesive, nails, sealant, or other fastening devices. In one exemplary embodiment, any fasteners (i.e. nails) that pass through the reroof shingles 320 are covered with the portion 321 of the overlying reroof shingle 320 that overlaps the underlying shingle. In some embodiments, a single layer of reroof shingles 320 is applied. In some embodiments, multiple layers of reroof shingles 320 are applied. In some embodiments, additional components, such as, for example, a rolled adhesive and a top sheet, may be installed between the existing roof 100 and the reroof shingles 320.

Figure 4:
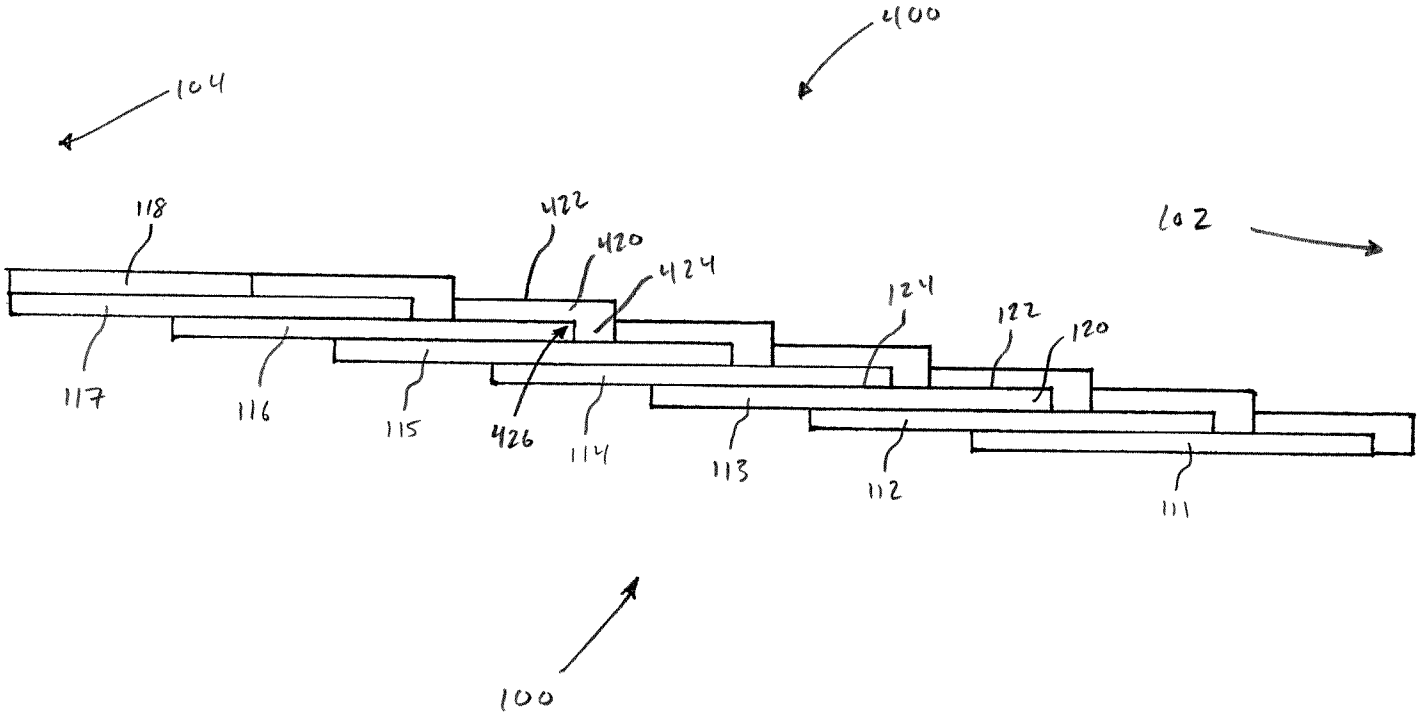
FIG. 4 is a cross-sectional view of exemplary reroofing shingles applied to shingles of the existing shingled roof.

Referring now to FIG. 4, an exemplary new roof 400 is shown installed on top of the existing roof 100. The new roof 400 is formed of reroof shingles 420 that are installed on top of the exposure portion 122 of the shingles 120 of the existing roof 100. The reroof shingles extend from a top edge to a bottom edge. The top edge of the reroof shingles abuts the bottom edge of the adjacent course of existing shingles. The reroof shingles 420 have an "L" shape and include an exposure portion 422 and a lip portion 424. The lip portion 424 extends below the exposure portion 422, forming a groove 426 that fits over the edge of the exposure portion 122 of the shingles 120 of the existing roof 100. The reroof shingles 420 can be installed starting at either the eave 102 or the ridge 104 of the roof 100. For example, a first course of shingles 420 can be installed on top of the exposure portion 122 of the seventh course 117 of the existing roof 100. Alternatively, a first course of shingles 420 can be installed on top of the exposure portion 122 of the first course 111 of the existing roof 100. Installing the new roof 400 from ridge 104 to eave 102 allows an installer to install the new roof 400 without stepping on the newly installed reroof shingles 420. The reroof shingles 420 may be attached to the existing roof 100 by any suitable means, such as, for example, adhesive, nails, sealant, or other fastening devices. In one exemplary embodiment, the re-roof shingles are installed with adhesives and fasteners do not extend through the re-roof shingles 220. In some embodiments, a single layer of reroof shingles 420 is applied. In some embodiments, multiple layers of reroof shingles 420 are applied. In some embodiments, additional components, such as, for example, a rolled adhesive and a top sheet, may be installed between the existing roof 100 and the reroof shingles 420.

Figure 5:
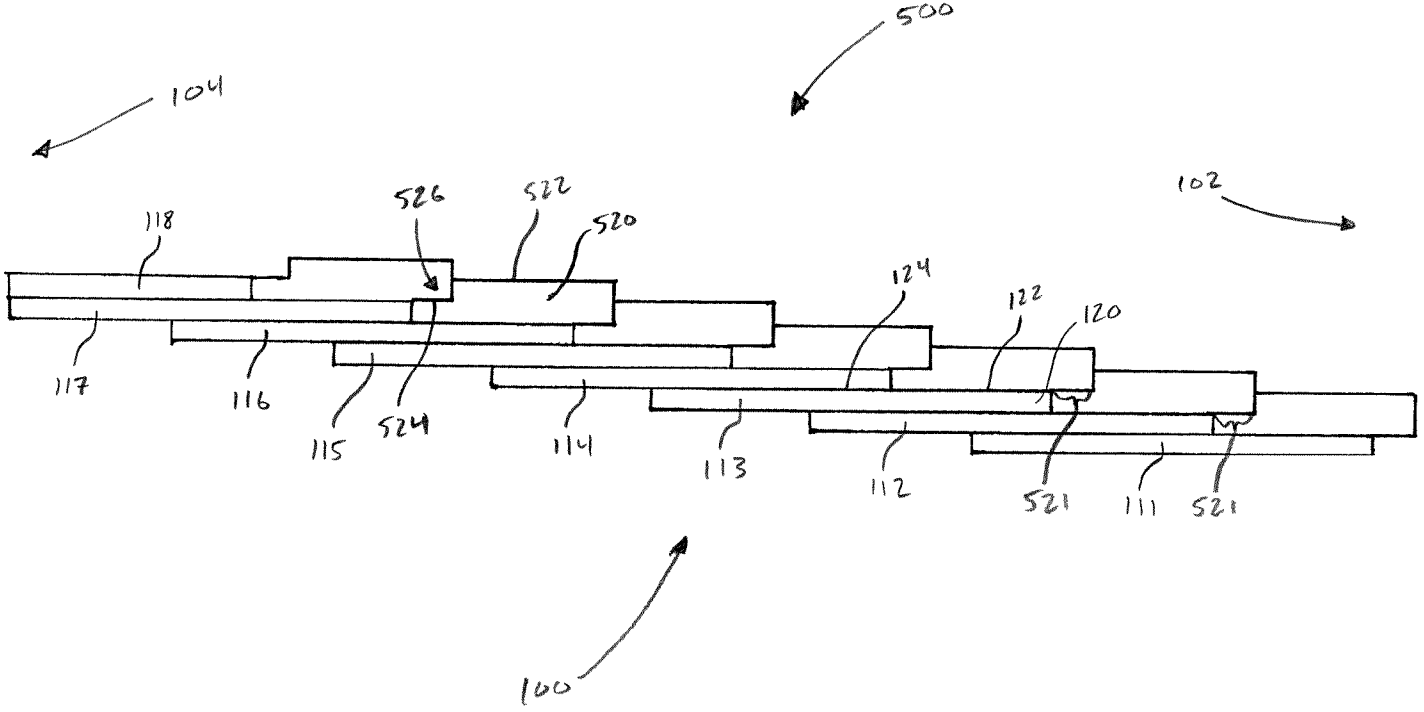
FIG. 5 is a cross-sectional view of exemplary reroofing shingles applied to shingles of the existing shingled roof.

Referring now to FIG. 5, an exemplary new roof 500 is shown installed on top of the existing roof 100. The new roof 500 is formed of reroof shingles 520 that are installed on top of the exposure portion 122 of the shingles 120 of the existing roof 100. The reroof shingles 520 include an exposure portion 522 and a headlap portion 524 that is thinner than the exposure portion 522, forming a groove 526. The reroof shingles extend from a top edge to a bottom edge. The top edge of the reroof shingles abuts the bottom edge of the adjacent course of existing shingles. The groove 526 receives the exposure portion 522 of an adjacent shingle 520 in the course above. The reroof shingle 520 is slightly wider than the exposure portion 122 of the shingles 120 of the existing roof 122 such that the reroof shingle 520 extends beyond the exposure portion 122 of the shingle 120. Extending the reroof shingle 520 beyond the exposure portion 122 of the shingle 120 provides additional protection by covering the seam between existing shingles 120 and reroof shingles 520. The reroof shingles 520 can be installed starting at either the eave 102 or the ridge 104 of the roof 100. For example, a first course of shingles 520 can be installed on top of the exposure portion 122 of the seventh course 117 of the existing roof 100. When starting at the ridge 104 of the roof 100, the headlap portion 524 of successive courses of reroof shingles 520 is inserted into the groove formed between the previous reroof shingle 520 and the exposure portion 122 of the course below until the groove 526 of the reroof shingle 520 butts against the exposure portion 522 of the shingle above. Alternatively, a first course of shingles 520 can be installed on top of the exposure portion 122 of the first course 111 of the existing roof 100. Installing the new roof 500 from ridge 104 to eave 102 allows an installer to install the new roof 500 without stepping on the newly installed reroof shingles 520. The reroof shingles 520 may be attached to the existing roof 100 by any suitable means, such as, for example, adhesive, nails, sealant, or other fastening devices. In one exemplary embodiment, any fasteners (i.e. nails) that pass through the reroof shingles 520 are covered with the portion 521 of the overlying reroof shingle 520 that overlaps the underlying shingle. In some embodiments, a single layer of reroof shingles 520 is applied. In some embodiments, multiple layers of reroof shingles 520 are applied. In some embodiments, additional components, such as, for example, a rolled adhesive and a top sheet, may be installed between the existing roof 100 and the reroof shingles 520.

Figure 6:
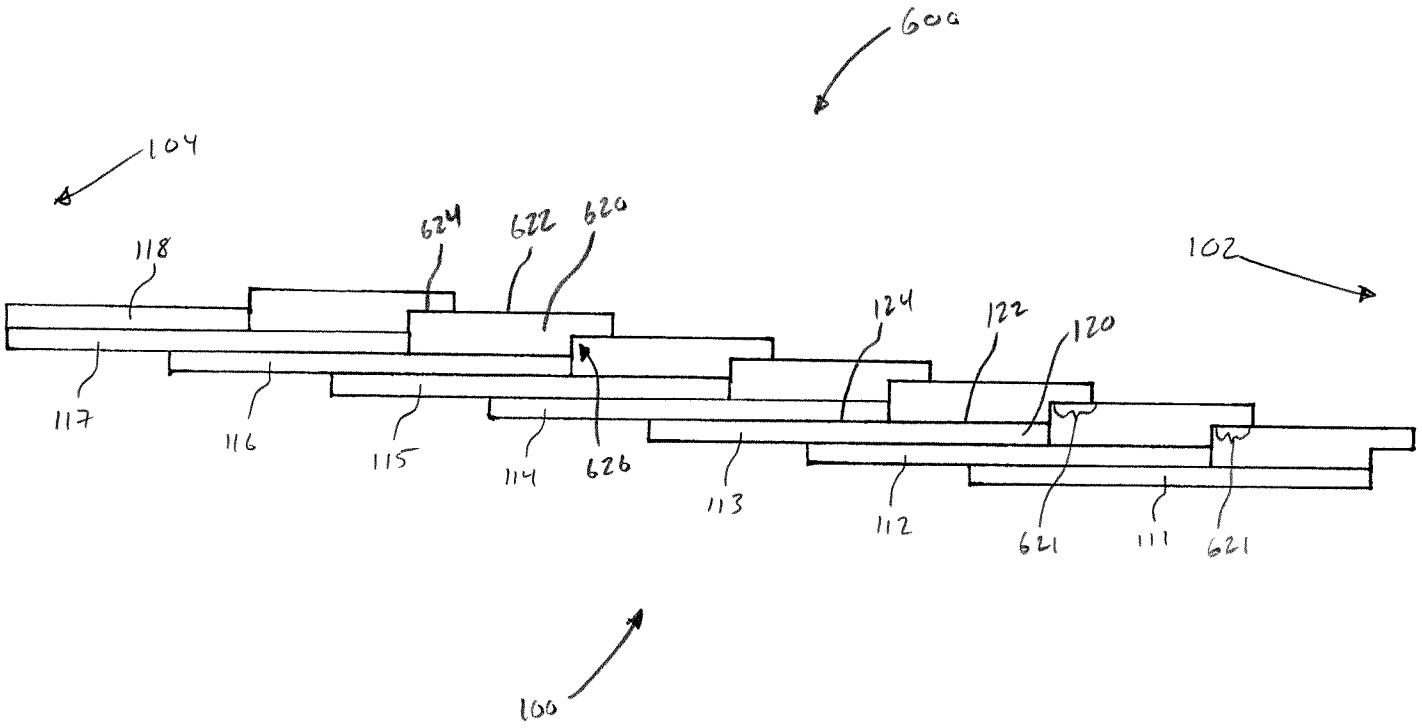
FIG. 6 is a cross-sectional view of exemplary reroofing shingles applied to shingles of the existing shingled roof.

Referring now to FIG. 6, an exemplary new roof 600 is shown installed on top of the existing roof 100. The new roof 600 is formed of reroof shingles 620 that are installed on top of the exposure portion 122 of the shingles 120 of the existing roof 100. The reroof shingles 620 include an exposure portion 622, a headlap portion 624, and a groove 626 along the bottom edge of the exposure portion 622. The reroof shingles extend from a top edge to the bottom edge. The top edge of the reroof shingles abuts the bottom edge of the adjacent course of existing shingles. The groove 626 receives the headlap portion 624 of an adjacent shingle 620 in the course above. The reroof shingle 620 is slightly wider than the exposure portion 122 of the shingles 120 of the existing roof 122 such that the reroof shingle 620 extends beyond the exposure portion 122 of the shingle 120. Extending the reroof shingle 620 beyond the exposure portion 122 of the shingle 120 provides additional protection by covering the seam between existing shingles 120 and reroof shingles 620. The reroof shingles 620 can be installed starting at either the eave 102 or the ridge 104 of the roof 100. For example, a first course of shingles 620 can be installed on top of the exposure portion 122 of the seventh course 117 of the existing roof 100. When starting at the ridge 104 of the roof 100, the headlap portion 624 of successive courses of reroof shingles 620 is inserted into the groove 626 of the course above until the reroof shingle 620 butts against the groove 626 of the shingle above. Alternatively, a first course of shingles 620 can be installed on top of the exposure portion 122 of the first course 111 of the existing roof 100. Installing the new roof 600 from ridge 104 to eave 102 allows an installer to install the new roof 600 without stepping on the newly installed reroof shingles 620. The reroof shingles 620 may be attached to the existing roof 100 by any suitable means, such as, for example, adhesive, nails, sealant, or other fastening devices. In one exemplary embodiment, any fasteners (i.e. nails) that pass through the reroof shingles 620 are covered with the portion 621 of the overlying reroof shingle 620 that overlaps the underlying shingle. In some embodiments, a single layer of reroof shingles 620 is applied. In some embodiments, multiple layers of reroof shingles 620 are applied. In some embodiments, additional components, such as, for example, a rolled adhesive and a top sheet, may be installed between the existing roof 100 and the reroof shingles 620.

Figure 7:
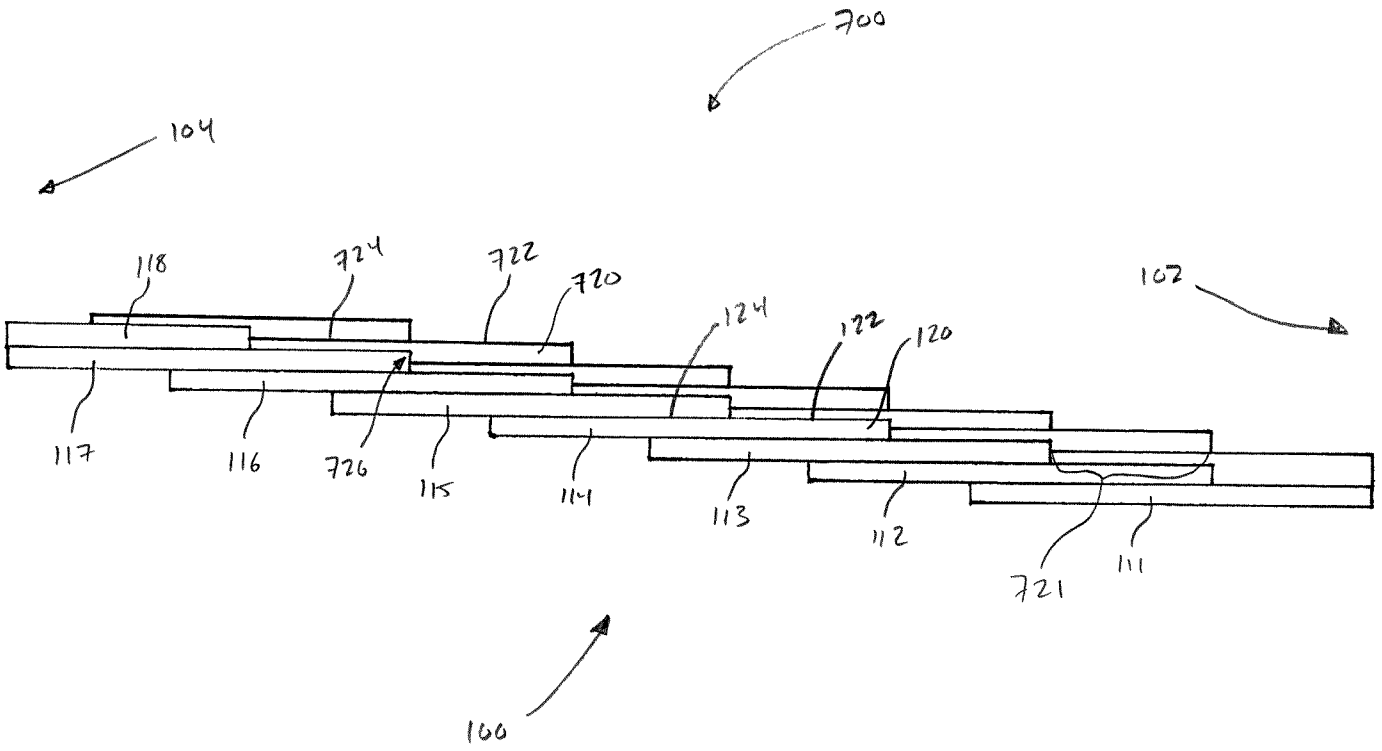
FIG. 7 is a cross-sectional view of exemplary reroofing shingles applied to shingles of the existing shingled roof.

Referring now to FIG. 7, an exemplary new roof 700 is shown installed on top of the existing roof 100. The new roof 700 is formed of reroof shingles 720 that are installed on top of the exposure portion 122 of the shingles 120 of the existing roof 100. The reroof shingles 720 include an exposure portion 722 and a thin headlap portion 724. The reroof shingles extend from a top edge to a bottom edge. The thin headlap portion 724 extends from the exposure portion 722 and covers the exposure portion 122 of the shingle 120 of the existing roof 100 to prohibit water infiltrating through the new roof 700. The thin headlap portion 724 extends from the face of the exposure portion 722, forming a groove 726 along the underside of the shingle 720. The groove 726 abuts the bottom edge of the adjacent course of existing shingles. The reroof shingles 720 are installed starting at the eave 102 of the roof 100 starting at the first course 111 and proceeding to the ridge 104. During installation, the reroof shingles 720 cover the exposure portion 122 of the shingles 120 of the existing roof 100 with the thin headlap portion 724. The groove 726 butts up against the exposure portion 122 of the next course. The reroof shingles 720 may be attached to the existing roof 100 by any suitable means, such as, for example, adhesive, nails, sealant, or other fastening devices. In one exemplary embodiment, any fasteners (i.e. nails) that pass through the reroof shingles 720 are covered with the portion 721 of the overlying reroof shingle 720 that overlaps the underlying shingle. In some embodiments, a single layer of reroof shingles 720 is applied. In some embodiments, multiple layers of reroof shingles 720 are applied. In some embodiments, additional components, such as, for example, a rolled adhesive and a top sheet, may be installed between the existing roof 100 and the reroof shingles 720.

Figure 8:
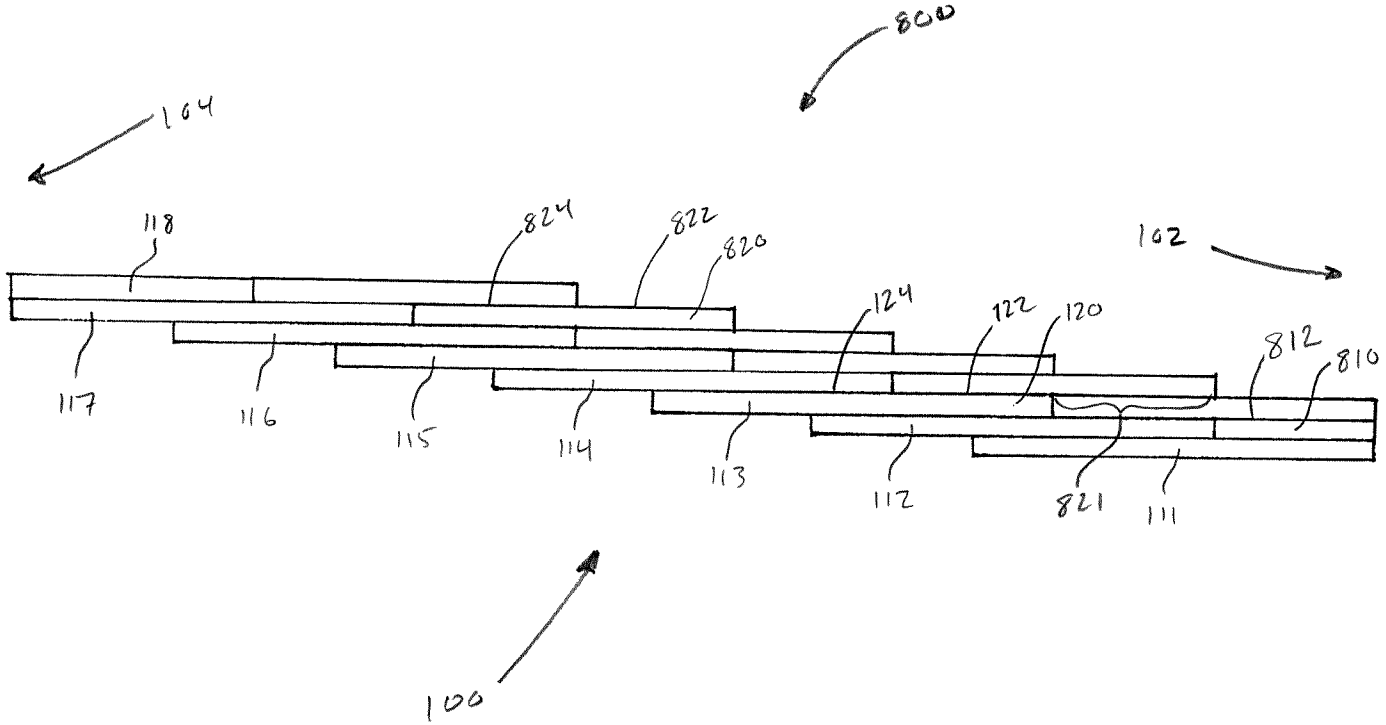
FIG. 8 is a cross-sectional view of exemplary reroofing shingles applied to shingles of the existing shingled roof.

Referring now to FIG. 8, an exemplary new roof 800 is shown installed on top of the existing roof 100. The new roof 800 is formed of reroof starter shingles 810 and reroof shingles 820 that are installed on top of the exposure portion 122 of the shingles 120 of the existing roof 100. The reroof starter shingles 810 include a headlap portion 814 and do not have an exposure portion. The reroof starter shingles 810 are approximately the same width as the exposure portion 122 of the shingles 120 of the existing roof 100. The reroof starter shingles extend from a top edge to a bottom edge. The top edge of the reroof starter shingles abuts the bottom edge of the adjacent course of existing shingles. The reroof shingles 820 include an exposure portion 822 and a headlap portion 824. The reroof shingles extend from a top edge to a bottom edge. The top edge of the reroof shingles abuts the bottom edge of the adjacent course of existing shingles. The reroof shingle 820 is wider than the exposure portion 122 of the shingle 120 of the existing roof 100 such that the reroof shingle 820 extends beyond the exposure portion 122 of the shingles 120. In the illustrated embodiment, the width of the shingle 820 is approximately twice the width of an exposure portion 122 of the shingles 120. The reroof shingles 820 are installed starting at the eave 102 of the roof 100 starting at the second course 112 and proceeding to the ridge 104. Before installing the reroof shingles 820, the first course 111 of the existing roof 100 is covered with reroof starter shingles 810 to provide sufficient support for the first course of reroof shingles 820. During installation, the reroof shingles 820 cover the exposure portion 122 of the shingles 120 of the existing roof 100 of the current and next course. The reroof shingles 820 may be attached to the existing roof 100 by any suitable means, such as, for example, adhesive, nails, sealant, or other fastening devices. In one exemplary embodiment, any fasteners (i.e. nails) that pass through the reroof shingles 820 are covered with the portion 821 of the overlying reroof shingle 820 that overlaps the underlying shingle. In some embodiments, a single layer of reroof shingles 820 is applied. In some embodiments, multiple layers of reroof shingles 820 are applied. In some embodiments, additional components, such as, for example, a rolled adhesive and a top sheet, may be installed between the existing roof 100 and the reroof shingles 820.

While various inventive aspects, concepts and features of the disclosures may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts and features of the disclosures—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present application even if such embodiments are not expressly disclosed herein. Additionally, even though some features, concepts or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated. Moreover, while various aspects, features and concepts may be expressly identified herein as being inventive or forming part of a disclosure, such identification is not intended to be exclusive, but rather there may be inventive aspects, concepts and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A roofing shingle system comprising:

a plurality of reroofing shingles each extending from a top edge to a bottom edge for a height that is at least an exposure height of an existing shingle roof and having a uniform thickness between the top edge and the bottom edge; and a plurality of courses of the reroofing shingles installed on a plurality of courses of the existing roof shingles, wherein a lower edge of each of the plurality of courses of the existing roof shingles is covered by only one of the plurality of courses of the reroofing shingles, and wherein the top edge of the reroofing shingles abuts a bottom edge of the adjacent course of the existing roof shingles.

2. The roofing shingle system of claim 1, further comprising:

a starter course of the reroofing shingles installed adjacent to a ridge course of the existing roof shingles; and at least one additional course of the reroofing shingles installed on at least one additional course of the existing roof shingles.

3. The roofing shingle system of claim 1, wherein the reroofing shingles have a height greater than the exposure height of the existing roof shingles to form an overlap portion extending beyond the lower edge of each of the plurality of courses of the existing roof shingles.

4. The roofing shingle system of claim 1, wherein at least one course of the reroofing shingles is installed over a course of the reroofing shingles.

5. The roofing shingle system of claim 1, wherein the thickness of the reroofing shingles is about equal to a thickness of the existing roof shingles.

6. The roofing shingle system of claim 1, wherein the reroofing shingles are installed with an adhesive.

7. The roofing shingle system of claim 1, wherein the reroofing shingles are installed without the use of nails.

8. The roofing shingle system of claim 1, wherein the reroofing shingles have a height that is not more than 1.5 times the exposure height of the existing roof shingles.

9. A roofing shingle system comprising:

a plurality of reroofing shingles each extending from a top edge to a bottom edge for a height that is not more than 1.5 times an exposure height of an existing roof shingle and having a uniform thickness between the top edge and the bottom edge; and at least one course of the reroofing shingles installed on at least one course of the existing roof shingles, wherein each course of the existing roof shingles is covered by only one course of the reroofing shingles, and wherein the top edge of the reroofing shingles abuts a bottom edge of the adjacent course of the existing roof shingles.

* * * * *